US006244726B1

(12) United States Patent
Fan Wong

(10) Patent No.: US 6,244,726 B1
(45) Date of Patent: Jun. 12, 2001

(54) DECORATIVE LAMP STRIP

(76) Inventor: Tsui-Tuan Fan Wong, 15th Fl.-D, No. 81, Sec. 1, Hsintai 5th Rd., Hsitzu Chen, Taipei Hsien (TW)

( * ) Notice: Subject to any disclaimer, the term of this patent is extended or adjusted under 35 U.S.C. 154(b) by 0 days.

(21) Appl. No.: 09/407,906

(22) Filed: Sep. 29, 1999

(51) Int. Cl.[7] ..... F21V 11/00

(52) U.S. Cl. ..... 362/240; 362/226; 362/238; 362/249

(58) Field of Search ..... 362/226, 240, 362/249, 238, 246, 248, 27

(56) References Cited

U.S. PATENT DOCUMENTS 4,680,685 * 7/1987 Altman ..... 362/240
4,908,743 * 3/1990 Miller ..... 362/238
5,416,678 * 5/1995 Schabowski ..... 362/249

* cited by examiner

*Primary Examiner*—Stephen Husar
(74) *Attorney, Agent, or Firm*—Dorsey & Whitney LLP

(57) ABSTRACT

An improved decorative lamp strip is disclosed. The improved decorative lamp strip includes a light bar and a covering to sheath the light bar. The light bar has a plurality of bulb-holders and a plurality of bulbs corresponding to the bulb holders, each bulb having first and second electrical conductors received within the respective bulb-holder. Each two adjacent bulb-holders have a socket defined therebetween. A tip of the first electrical conductor is joined by twisting to a tip of a respective one of the second electrical conductors. The joined tips of the first and second electrical conductors are received in a respective one of the sockets between the adjacent bulbs.

10 Claims, 7 Drawing Sheets

DECORATIVE LAMP STRIP

BACKGROUND OF THE INVENTION

1. Field of the Invention

The present invention is related to an improved decorative lamp strip, and more particular to a decorative lamp strip which is easy to produce and use, and has decreased cost.

2. Description of Related Art

FIGS. 7 and 8 show a conventional decorative lamp strip. The decorative lamp strip has a certain flexibility and can be wound around trees etc. to form a special configuration. The conventional decorative lamp strip comprises a light bar (80) and a covering (90) to sheath the light bar (80) for electrical insulation and water resistance.

The light bar (80) is made of a transparent flexible material and comprises a plurality of bulb-holders (81) defined therein. Bulbs (82) each having two a first conductor (820) and a second conductor (822) are respectively mounted in the bulb-holders (81) and arranged along the light bar (80). Each two adjacent bulb-holders (81) have a socket (83) defined therebetween. The sockets (83) each receive one of a plurality of metal pins (85). Two channels (84) are defined in diametrically opposite surfaces of the light bar (80) and in communication with the bulb-holders (81) and the sockets (83).

The first and second conductors (820,822) are each formed as an inverted 'U' with a left leg, a central portion and a right leg. The right leg of each first conductor (820) and the left leg of the corresponding second conductor (822) are received in a respective bulb-holder (81). The left leg of the first conductor (820) is received in a respective preceding socket (83) and the right leg of the second conductor (822) is received in a following socket (83) whereby the sockets (83) each receive corresponding legs of first and second conductors (820,822) which are then electrically connected and secured in position with a respective one of the metal pins (85). In this way, all the bulbs (82) are electrically connected to construct a circuit. The central portions of the first and second conductors (820,822) are received in a same one of the channels (84).

However, because the light bar (80) has a certain flexibility, when it is bent, the metal pins (85) may be loosened and the reliability of the electrical connection between the first and second conductors (820,822) and the metal pins (85) is decreased. As the quantities of metal pins (85) and bulbs (80) must be the same, when there is a large number of bulbs (82) provided in the light bar (80), the number of the metal pins (85) is also large. Thereby, the product cost of the decorative lamp strip will be high. Moreover, these metal pins (85) will increase the weight of the decorative lamp strip and therefore increase inconvenience in use, as well possibly bringing harm to the trees or other objects decorated therewith.

Therefore, the invention tends to provide an improved decorative lamp strip to mitigate and/or obviate the aforementioned problems.

SUMMARY OF THE INVENTION

The main objective of the present invention is to provide an improved decorative lamp strip which can ensure the reliability of the electric circuit.

Another objective of the present invention is to provide an improved decorative lamp strip which is convenient to produce.

Another objective of the present invention is to provide an improved decorative lamp strip which eliminates conductive elements and thereby decreases the product cost.

Other objects, advantages and novel features of the invention will become more apparent from the following detailed description when taken in conjunction with the accompanying drawings.

DETAILED DESCRIPTION OF THE PREFERRED EMBODIMENT

Figure 1:
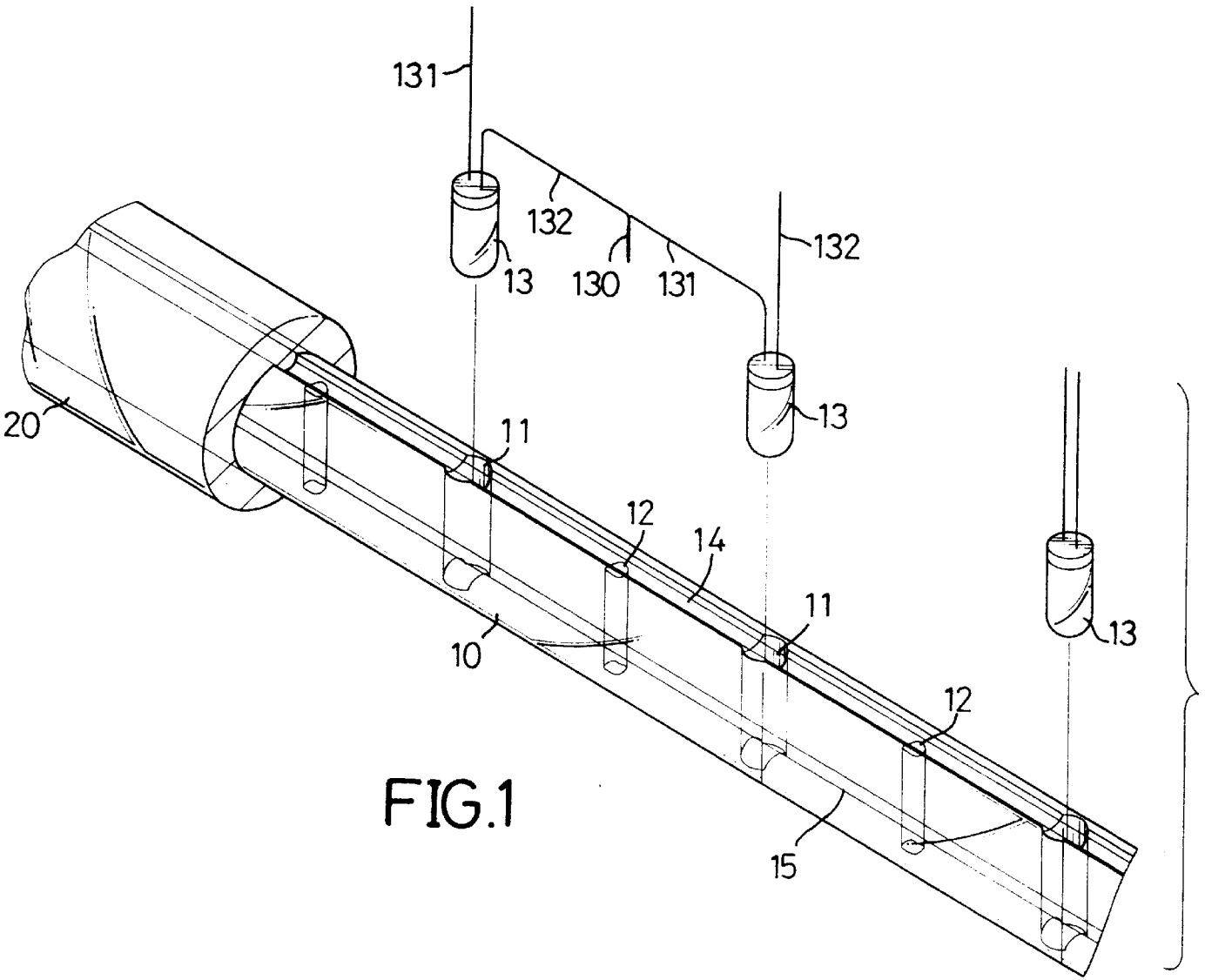
FIG. 1 is a top perspective view of an improved decorative lamp strip of the present invention.

Referring to FIG. 1, a decorative lamp strip in accordance with the present invention comprises a light bar (10) and a transparent covering (20) to sheath the light bar (10).

The light bar (10) has a plurality of bulb-holders (11) defined therein and an identical plurality of bulbs (13) respectively received in the bulb-holders (11). One of a plurality of sockets (12) is defined between each two adjacent bulb-holders (11). Two channels (14) are respectively defined in two diametrically opposite surfaces of the light bar (10) and in communication with the bulb-holders (11) and sockets (12). At least one steel cable (15) is received in the light bar (10) to reinforce its construction strength. For example, the embodiment has two steel cables (15) provided in the light bar (10).

The bulbs (13) each have a first conductor (131) and a second conductor (132). The first and second conductors (131,132) are each formed as an inverted 'U' with a left leg, a central portion, and a right leg. The right leg of each first conductor (131) and the left leg of the corresponding second conductor (132) are received in a respective one of the bulb-holders (11). The left leg of each first conductor (131) is received in a respective preceding socket (12) and the right leg of the corresponding second conductor (132) is received in a following socket (12), whereby the sockets (12) each receive corresponding legs of the first and second conductors (131,132) after a binding operation which is described as follows. The right leg/left leg combinations of the first and second conductors (131, 132) from adjacent bulbs (13) are twisted together to form a twisted wire (130). The twisted wires (130) are respectively received in the sockets (12). All the bulbs (13) are electrically connected in series in this way. The central portions of the first and second conductors (131, 132) are are located in a same one of the channels (14).

Figure 2:
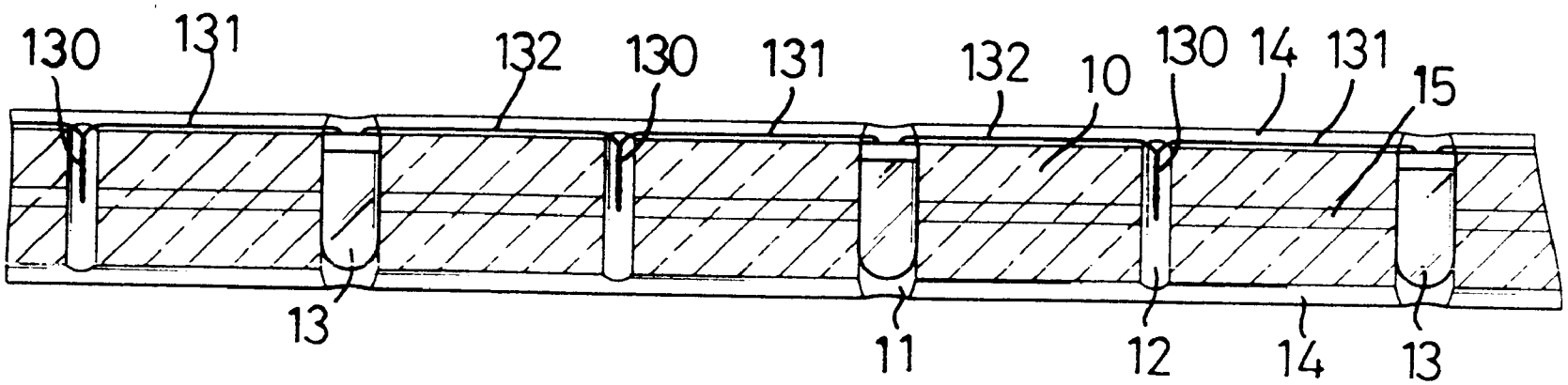
FIG. 2 is a cross-sectional side view of a light bar of the decorative lamp strip of the present invention.

FIG. 2 shows the configuration of the bulbs (13) having been mounted in the bulb-holders (11).

Although the twisted wire (130) can be formed by hand, the present invention also provides a special twister (30)

used for twisting the combined left and right legs of the adjacent bulbs (13).

Figure 3:
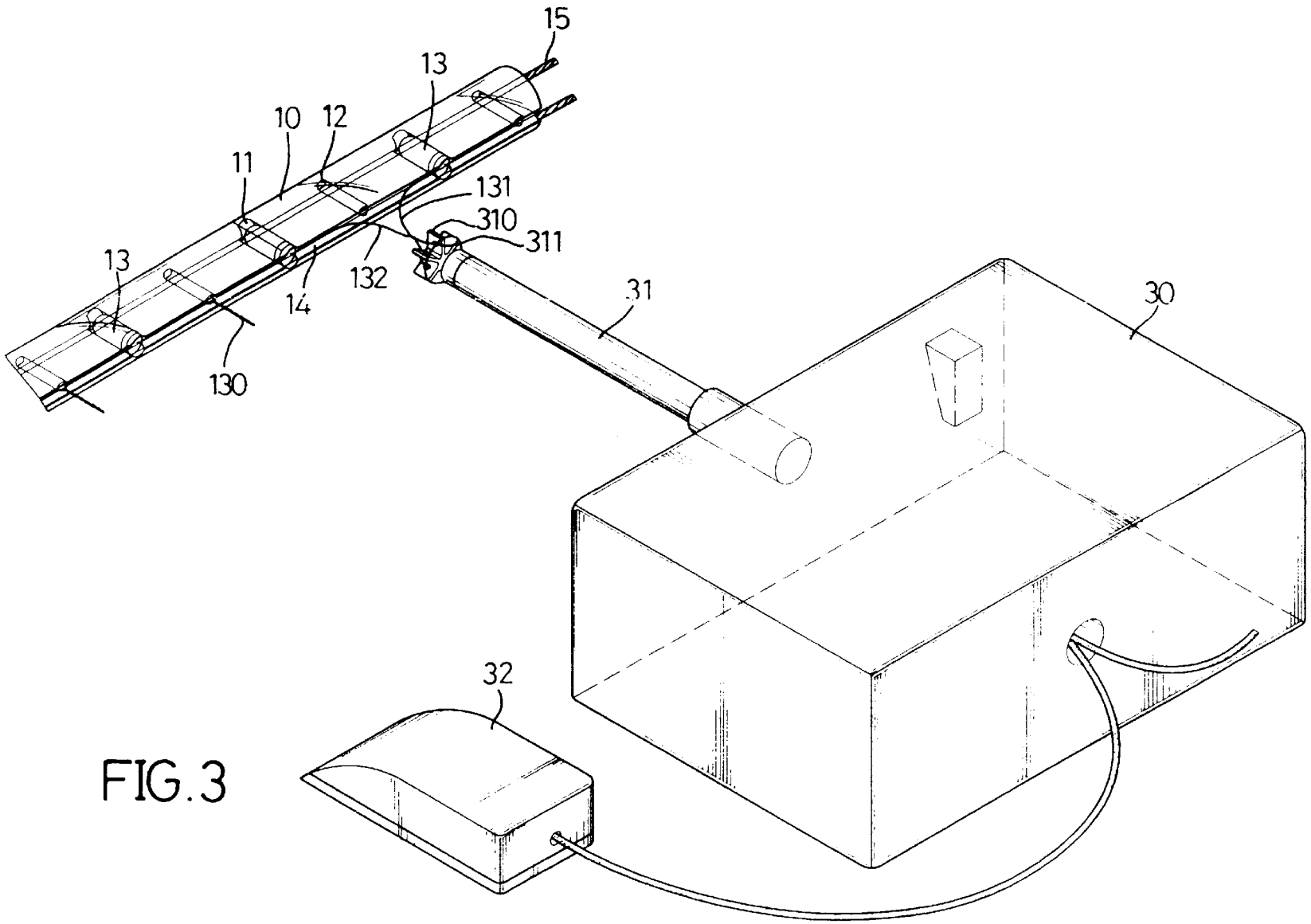
FIG. 3 is a top perspective view showing a twister to twist conductors of bulbs in accordance with the present invention.
Figure 4:
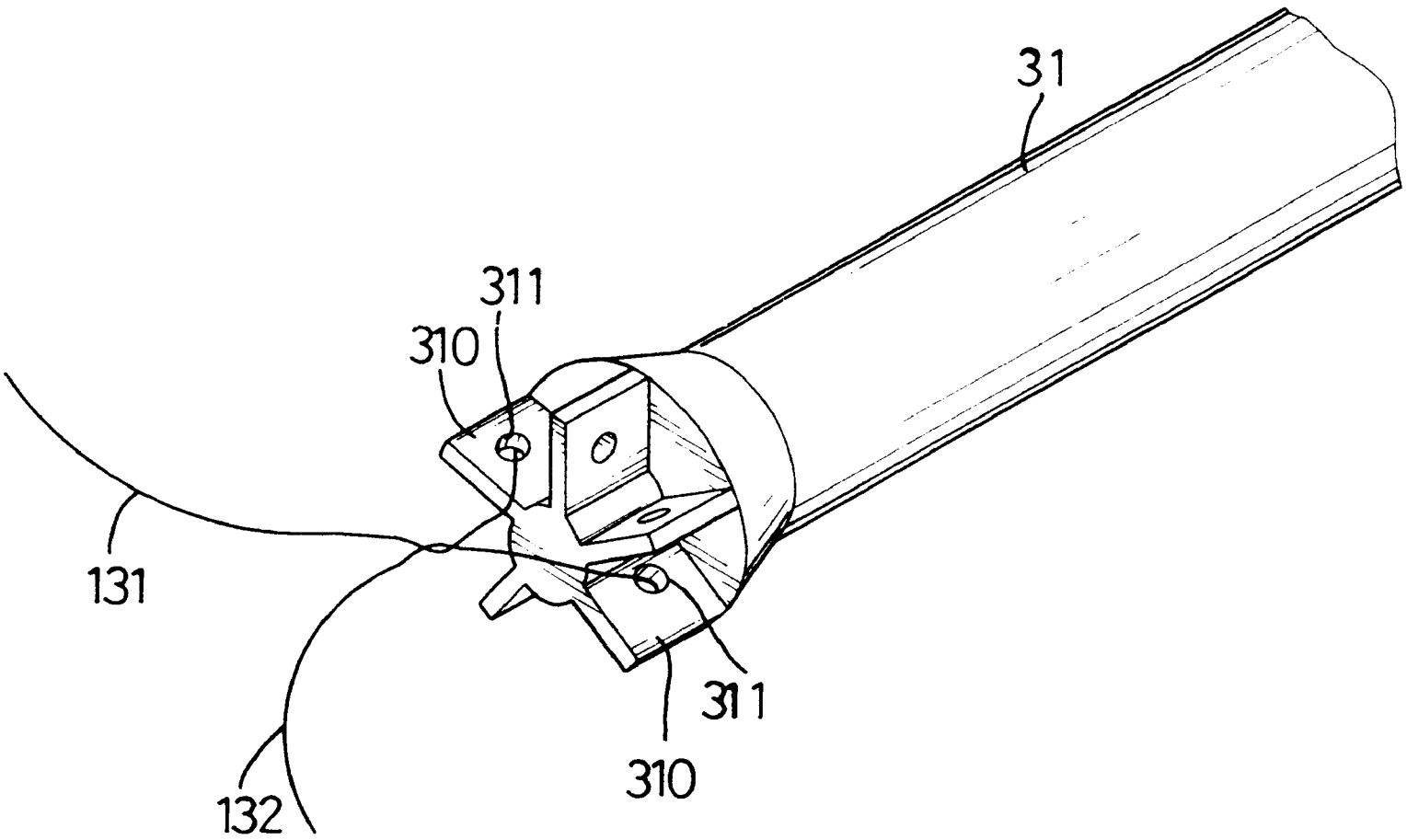
FIG. 4 is a top perspective view showing the front end of a shaft of the twister.

Referring to FIGS. 3 and 4, the twister (30) comprises a shaft (31) extended out from the twister body (not numbered). A transmission mechanism (not shown) to drive the shaft (31) is provided inside the twister (30). A footswitch (32) is electrically connected with the transmission mechanism to activate/deactivate the twister (30).

Figure 6:
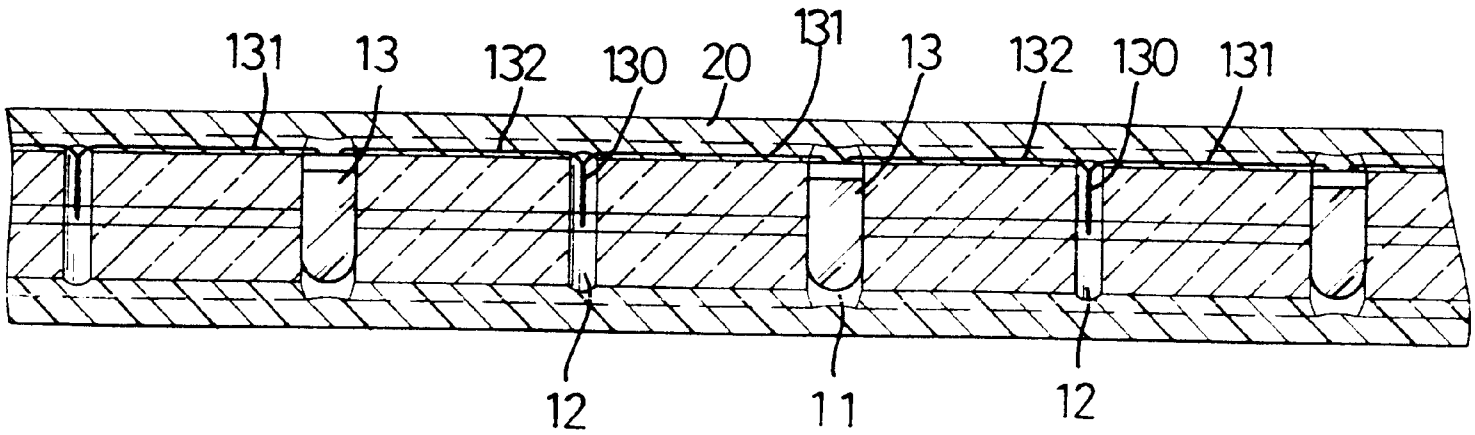
FIG. 6 is a cross-sectional side view showing the decorative lamp strip having been assembled.
Figure 5:
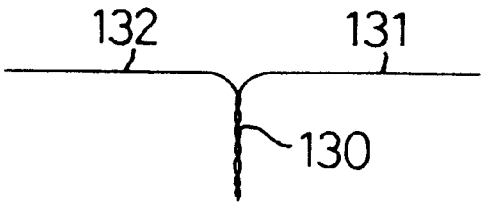
FIG. 5 is a partial enlarged view showing the conductors twisted by the twister.
Figure 7:
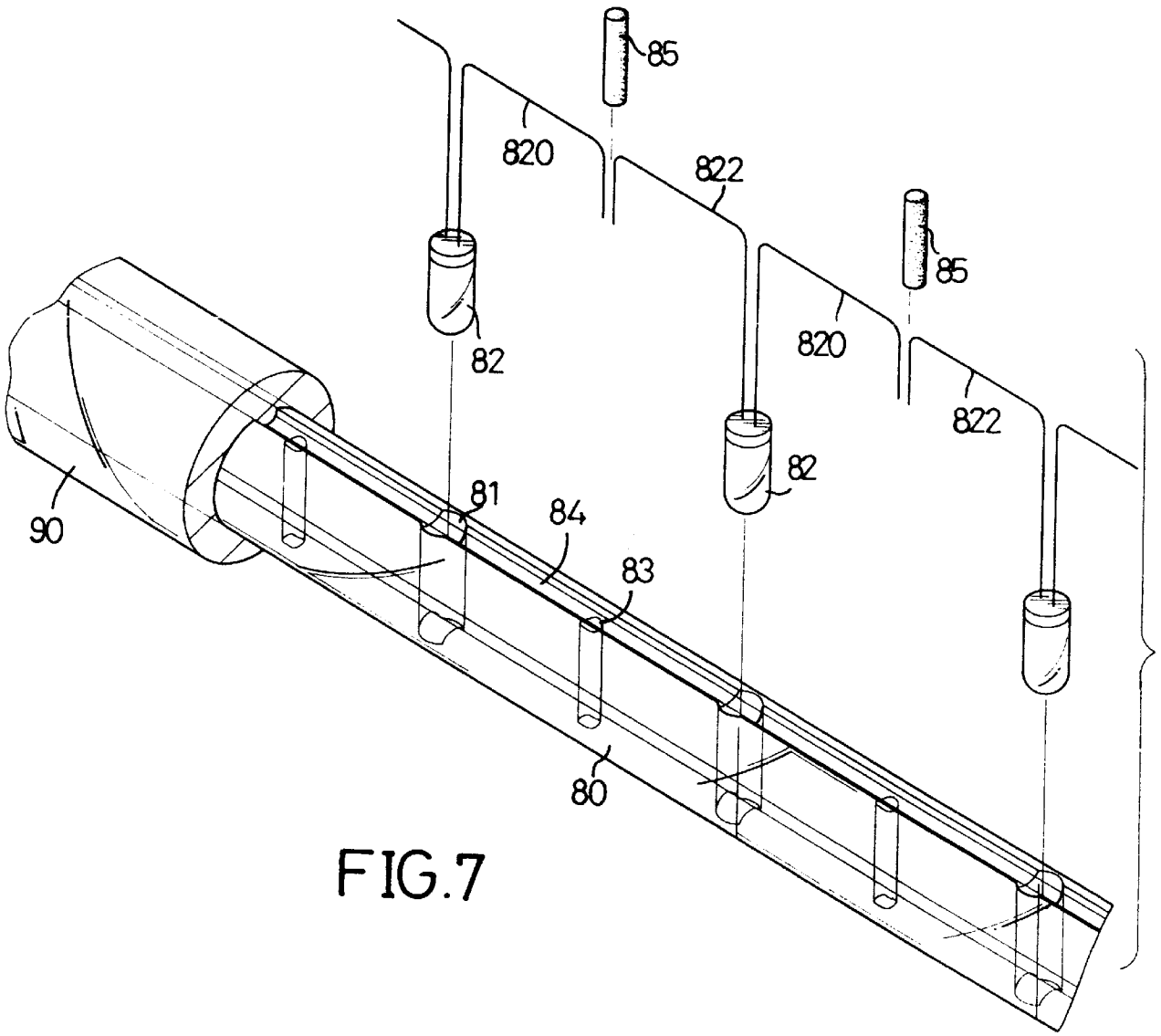
FIG. 7 is a top perspective view of a conventional decorative lamp strip.
Figure 8:
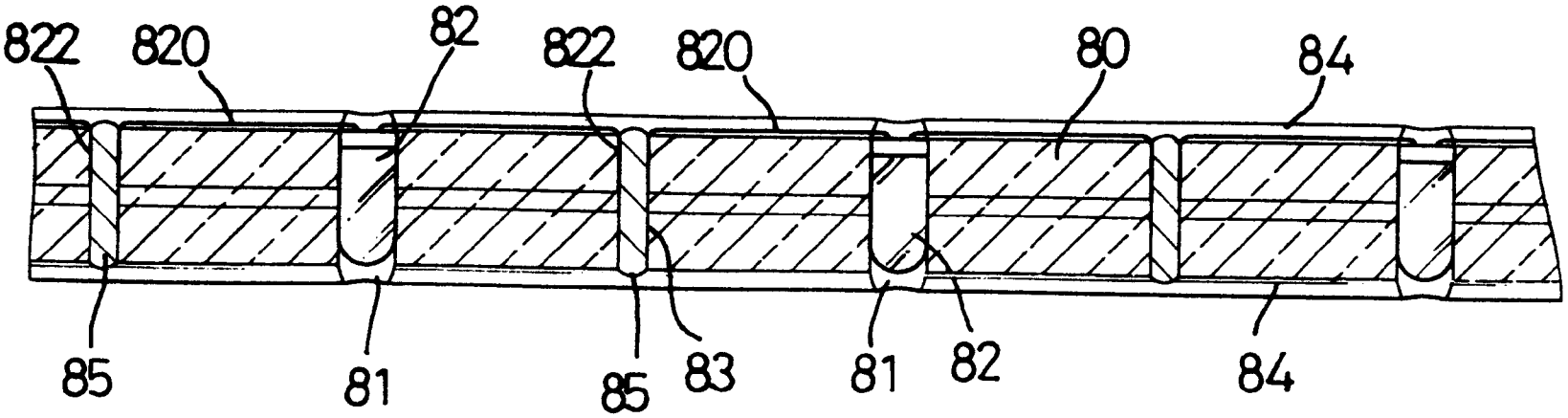
FIG. 8 is a cross-sectional side view of the conventional decorative lamp strip.

The shaft (31) comprises a plurality of ribs (310) radially formed at the front end thereof. Each rib (310) defines an aperture (311) which receives a respective one of the left and right legs. In operation, each pair of the left and right legs is inserted at a time into any two apertures (311) and the twister (30) is switched on to rotate the shaft (31). After a specific number of rotations of the shaft (31), the left and right legs are twisted together to form the twisted wire (130), as shown in FIG. 5. Then, the twisted wire (130) can be received in the corresponding socket (12) of the light bar (10), as shown in FIGS. 2 and 6.

From the above description, the invention has the following advantages:

1. By the direct electrical connection of the first and second conductors of the bulb, the metal pin is eliminated, so the cost of the decorative lamp strip is decreased;
2. The decorative lamp strip is lightweight because the metal pin is eliminated;
3. Because the left and right legs are directly electrically connected by the twister, the process is simplified and the operating efficiency is raised.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved decorative lamp strip comprising:

illuminating means including a plurality of light sources;

a plurality of receivers corresponding to the plurality of light sources and receiving the light sources respectively therein;

a plurality of sockets corresponding to the plurality of receivers and each socket being defined between a respective two adjacent receivers;

a plurality of first electrical conductors, each first electrical conductor extending between a respective one of the plurality of light sources and a preceding one of the plurality of sockets;

a plurality of second electrical conductors, each second electrical conductor extending between the respective one of the plurality of light sources in contact with the first electrical conductor and a following one of the sockets; and a transparent sheath electrically insulating the illuminating means; wherein each socket receives a respective one of the first electrical conductors, and a respective one of the second electrical conductors joined to the respective one of the first electrical conductors.

2. The improved decorative lamp strip as claimed in claim 1, wherein the first electrical conductor and the second electrical conductor are each formed as an inverted 'U', and comprise a left leg, a central portion, and a right leg, wherein the left side tip of the first conductor is formed as the left leg, and the right side tip of the second conductor is formed as the right leg.

3. The improved decorative lamp strip as claimed in claim 2, wherein the left leg of the first electrical conductor is received in one of the sockets preceding a respective one of the receivers and the right leg of the first electrical conductor is received in the respective receiver.

4. The improved decorative lamp strip as claimed in claim 2, wherein the right leg of the second electrical conductor is received in one of the sockets following a respective one of the receivers and the left leg of the second electrical conductor is received in the respective receiver.

5. The improved decorative lamp strip as claimed in claim 4, wherein the first electrical conductors and the second electrical conductors are joined by twisting.

6. The improved decorative lamp strip as claimed in claim 2, wherein the right leg of each first electrical conductor is twisted together with the left leg of a respective one of the second electrical conductors.

7. The improved decorative lamp strip as claimed in claim 1, wherein the light sources are bulbs.

8. The improved decorative lamp strip as claimed in claim 1, wherein the receivers are bulb-holders.

9. The improved decorative lamp strip as claimed in claim 1, wherein the illuminating means is a light bar.

10. The improved decorative lamp strip as claimed in claim 1 further comprising at least one steel cable longitudinally formed in the illuminating means to reinforce the construction strength thereof and two channels defined in diametrically opposite positions in the illuminating means to communicate with the receivers and sockets.

* * * * *